US007861732B2

(12) United States Patent
Publ

(10) Patent No.: US 7,861,732 B2
(45) Date of Patent: Jan. 4, 2011

(54) IMMERSION CLEANER FOR PRINT ROLLERS

(75) Inventor: Rudy Publ, Glendale Heights, IL (US)

(73) Assignee: Safety-Kleen Systems, Inc., Plano, TX (US)

( * ) Notice: Subject to any disclaimer, the term of this patent is extended or adjusted under 35 U.S.C. 154(b) by 103 days.

(21) Appl. No.: 11/948,580

(22) Filed: Nov. 30, 2007

(65) Prior Publication Data

US 2009/0139549 A1 Jun. 4, 2009

(51) Int. Cl.
*B08B 3/04* (2006.01)
*B08B 3/12* (2006.01)

(52) U.S. Cl. ..... 134/148; 134/138; 134/153; 134/184; 134/186; 134/200

(58) Field of Classification Search ..... 134/138, 134/148, 153, 184, 186, 200
See application file for complete search history.

(56) References Cited

U.S. PATENT DOCUMENTS

| | | | | | |
|---|---|---|---|---|---|
| 2,574,058 | A | | 11/1951 | Porter | |
| 2,724,392 | A | * | 11/1955 | Cooper | 134/46 |
| 2,896,648 | A | | 7/1959 | Lazarus | |
| 3,285,780 | A | | 11/1966 | Lockerbie | |
| 3,428,060 | A | * | 2/1969 | Spivey | 134/141 |
| 4,448,209 | A | * | 5/1984 | Lindsay | 134/141 |
| 5,186,193 | A | * | 2/1993 | Gullberg et al. | 134/105 |
| 5,232,299 | A | | 8/1993 | Hiss | |
| 5,291,827 | A | | 3/1994 | Liers et al. | |
| 5,490,460 | A | * | 2/1996 | Soble et al. | 101/424 |
| 5,614,027 | A | | 3/1997 | Dunn et al. | |
| 5,636,571 | A | | 6/1997 | Abrahamson | |
| 5,674,827 | A | | 10/1997 | Kawashima et al. | |
| 6,044,852 | A | * | 4/2000 | Epperson et al. | 134/56 R |
| 6,668,844 | B2 | | 12/2003 | Lund et al. | |
| 6,821,355 | B1 | | 11/2004 | Taylor et al. | |
| 2002/0017209 | A1 | | 2/2002 | Gutfleisch et al. | |
| 2002/0083958 | A1 | | 7/2002 | Bran | |
| 2003/0010363 | A1 | | 1/2003 | Cotte et al. | |
| 2003/0062067 | A1 | | 4/2003 | Meyer et al. | |
| 2003/0062071 | A1 | | 4/2003 | Sorbo et al. | |

* cited by examiner

*Primary Examiner*—Michael Kornakov
*Assistant Examiner*—Natasha Campbell
(74) *Attorney, Agent, or Firm*—Vedder Price P.C.

(57) ABSTRACT

What is contemplated is a printing cylinder washer having a removable or portable drive assembly, or a series of portable drive assemblies of different lengths to accommodate different sizes of print rollers. The drive assemblies have a drive mechanism enabled by a dynamic flow of cleaning solution within the washer reservoir. What is also contemplated is the use of an elevation system, an agitation platform, under-immersion spray bars, an ultrasonic wave cleaning system, and a hatch or door equipped with a thermal breaker in conjunction with the hydro-driven portable drive assembly. What is also contemplated is a method of washing printing rollers within the above-described printing cylinder washer by aligning a nozzle with the drive assembly.

12 Claims, 8 Drawing Sheets

IMMERSION CLEANER FOR PRINT ROLLERS

FIELD OF THE DISCLOSURE

The present disclosure relates to an immersion cleaner for print rollers, and more specifically, to a printing cylinder washer having a drive assembly in the immersion cleaner with a drive mechanism enabled by a directional flow of circulating cleaning solution in the reservoir.

BACKGROUND

Mechanical parts collect dirt, abrasion residue, used grease, and other debris during normal operation. Rollers in the printing industry are used to lick ink or other chemicals from reservoirs and spread these chemicals across substrates in a well-defined pattern found on other rollers. Print rollers progressively collect dirt, loose particles, and even dry ink. Five different technologies are know in the industry: manual parts washing, automatic parts washing, spray-under-immersion cleaning, soaked parts washing and abrasive blast cleaning using a variety of different media. Washing print rollers can be done manually using a sponge, a brush, or a towel or facilitated using automated devices. Some devices operate onsite without the need for the removal of the print roller, while others operate offsite once the print roller is removed and transported to a print roller cleaner. The current disclosure relates to automatic parts washers using immersion cleaning with or without spray-under-immersion cleaning and soak washing under immersion.

A parts washer is an apparatus that cleans parts, either individually or in groups, including but not limited to cleaning of machinery and machine parts or print rollers. Immersion cleaners are a subgroup of parts washers where mechanical parts, such as print rollers, are immersed in a cleaning solution during cleaning operations. The core technology associated with immersion cleaners is not unlike the technology associated with the immersion cleaning of automobile parts at repair shops. Some parts washers use an aqueous cleaning solution to dissolve and remove grease, carbon, resins, tar, inks, and other debris. These parts washers use water, soap, and/or detergents, either common or proprietary. Other more aggressive parts washers use hydrocarbon-based solvents or other solvents to degrease and wash parts. Cleaning solutions may in some cases be abrasive, solvent based, or corrosive and require confinement and ultimately recycling. Even if water-based solutions are used in the immersion process, the washed residue can be abrasive, solvent based, or corrosive and require confinement, filtration, and processing.

Print rollers are generally heavy cylindrical parts with somewhat delicate printing surfaces having two supporting ends also of cylindrical shape. Rollers of different lengths and radii must be used in the printing industry, often in tandem on a single printing press. Print roller washers must accommodate differently sized rollers with different lengths, radii, and weights. Cleaning requires relative movement of the cleaning solution and the surface of the printing roller to help with the dissolution of dirt particles in the cleaning solution. The most efficient way to move the roller in the cleaning solution is to allow the roller to roll creating a maximum velocity of cleaning solution at the surface. Other relative movements are difficult because of the inertia of the roller in the fluid. To rotate the print rollers, a driving means is require, in the prior art, mechanically driven means are used, either via chains, belts, connected to a motor. Unlike the cleaning solution that can easily be regenerated, the driving means and motor must periodically be cleaned. What is needed is a driving means that does not require any periodic maintenance or cleaning. Another common problem of the prior art is the incapacity to clean both the entire printing surface and the ends, the prior art systematically holds the print roller either on wheels located at a position along the printing surface or by the ends. In both cases, lines or surfaces cannot be effectively cleaned. What is needed is a support system, that reduces cleaning interferences by allowing the cleaning solution to reach the entire external surface of the print roller during washing operations. One model of immersion print roller washer from the prior art, described in U.S. Pat. No. 5,291,827, disclose a large, rectangular reservoir where the print roller is immersed in a cleaning solution. The sides of the reservoir are equipped with a lowering and holding mechanism. A roller chain driven drive mechanism attached to support rollers and rotates the print rollers to be washed. Obvious disadvantages of this system includes the incapacity to accommodate narrow print rollers and the need to use a drive mechanism partly immersed in the cleaning solution, that pulls cleaning solution out of the reservoir and ultimately degrades a non-immersed motor.

A more recent model from the prior art, described in U.S. Pat. No. 5,636,571, is equipped with a large, open reservoir to accommodate a plurality of rollers attached to the top surface of the reservoir. Rail systems can be adjusted to accommodate narrow print rollers and the drive mechanism is external to the reservoir and supports part of the print rollers held outside of the cleaning solution. The obvious disadvantages of this system includes the incapacity to clean one of the critical portion of the print roller: the supporting ends. This device also requires a top cover to prevent splashing or evaporation of fumes during the washing process.

In another type of print roller immersion washer described in U.S. Pat. No. 5,490,460, print rollers are fully immersed in cleaning solution in an reservoir but are placed on rotating pegs in contact with the delicate printing surface of the print roller while the driving mechanism rotates the roller in the cleaning solution. A single belt-based drive mechanism is shown and connected with a motor located outside of the reservoir. Obvious disadvantages of this device is the need for sets of wheels and the incapacity to clean a print roller without resorting to a full support on the printing surface over wheels near the extremity of the print roller.

In another type of print roller immersion washer described in U.S. Pat. No. 5,490,460, print rollers are fully immersed in cleaning solution in an reservoir but are placed on rotating pegs in contact with the delicate printing surface of the print roller while the driving mechanism rotates the roller in the cleaning solution. A single belt-based drive mechanism is shown and connected with a motor located outside of the reservoir. Obvious disadvantages of this device is the need for sets of wheels and the incapacity to clean a print roller without resorting to a full support on the printing surface over wheels near the extremity of the print roller.

What is needed is a immersion cleaner for print rollers capable of cleaning the entire print roller without damaging the printing surface of the print rollers. What is also needed is an immersion cleaner capable of rotating print rollers without the need for a roller chain or a strap in the interface between the cleaning solution and the dry portion of the printing cylinder washer.

SUMMARY

What is contemplated in one aspect of the present disclosure is a printing cylinder washer having a removable or portable drive assembly, or a series of portable drive assemblies of different lengths to accommodate differently sized print rollers. The drive assemblies have a drive mechanism enabled by a dynamic flow of cleaning solution within the washer reservoir. What is also contemplated is the use of an elevation system, an agitation platform, under-immersion spray bars, an ultrasonic-wave cleaning system, and a hatch or door equipped with a thermal breaker in conjunction with the hydro-driven portable drive assembly. What is also contemplated is a method of washing printing rollers within the above-described printing cylinder washer by aligning a nozzle with the drive assembly. The use of a plurality of small friction tabs also improves the contact of the cleaning solution with the entire printing surface.

BRIEF DESCRIPTION OF THE DRAWINGS

Certain embodiments are shown in the drawings. However, it is understood that the present disclosure is not limited to the arrangements and instrumentality shown in the attached drawings, wherein.

DETAILED DESCRIPTION

The present invention is not limited to the particular details of the device depicted, and other modifications and applications may be contemplated. Further changes may be made in the device described herein without departing from the true spirit of the scope of the disclosure. It is intended, therefore, that the subject matter of the above depictions be interpreted as illustrative, not in a limiting sense.

Figure 1:
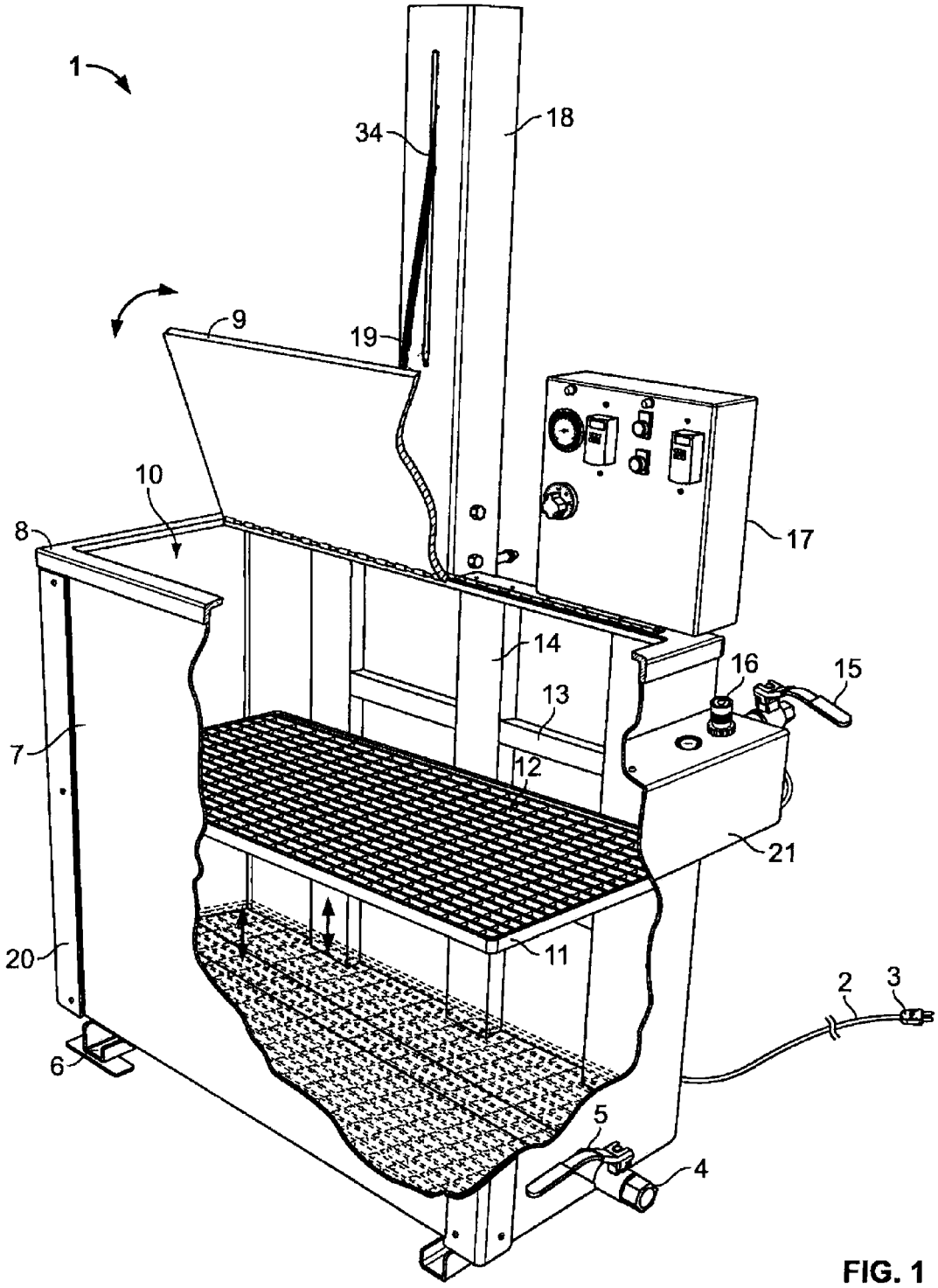
FIG. 1 is a perspective view of the printing cylinder washer without the drive assembly shown with an open reservoir door with the support table in a high position and illustrated in dashed line in a low position according to an embodiment of the present disclosure.
Figure 8:
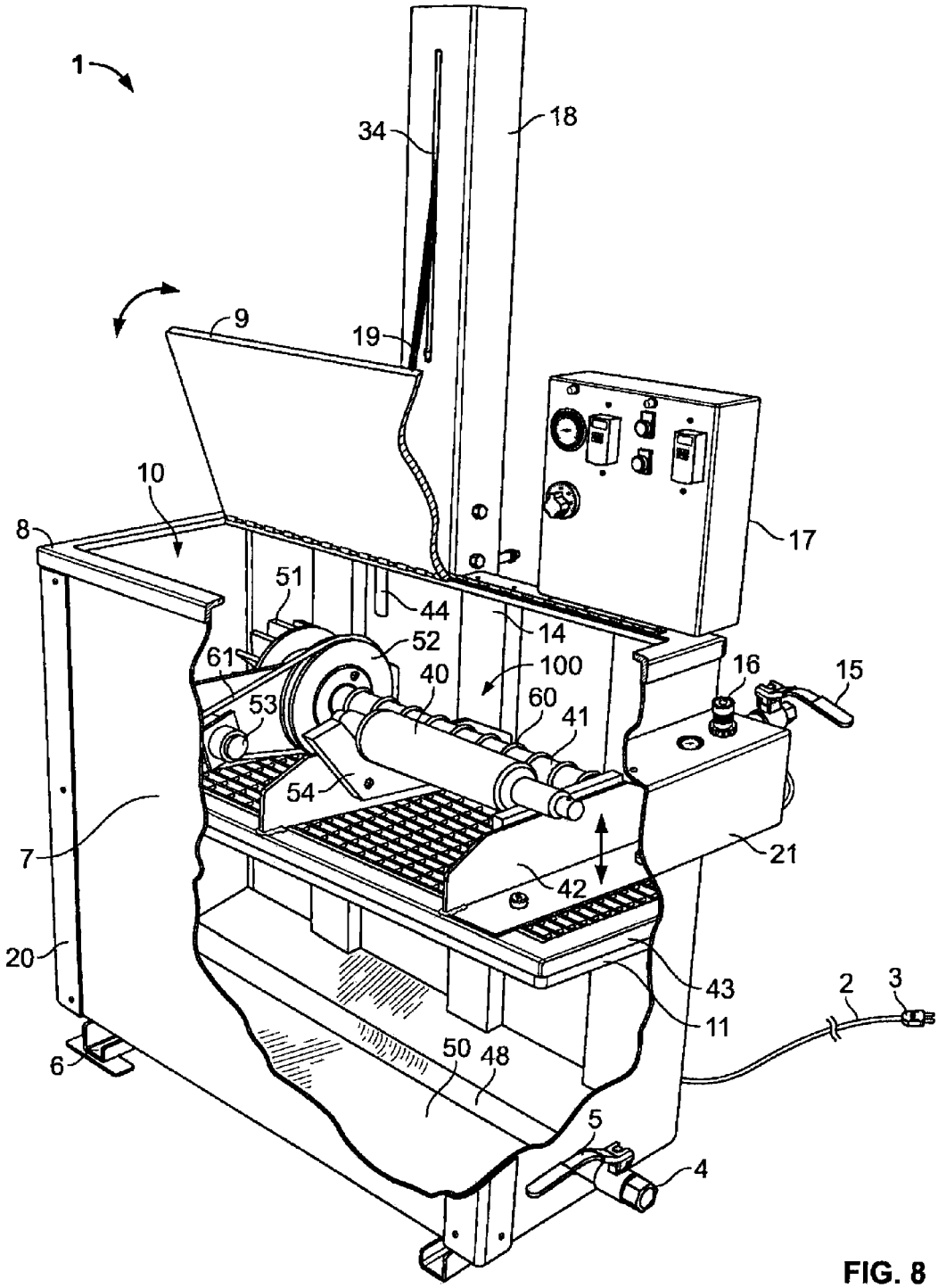
FIG. 8 is a perspective view of the printing cylinder washer shown with an open reservoir door and the support table in a high position with the drive assembly and a printing cylinder in the high position according to an embodiment of the present disclosure.

FIG. 8 shows a perspective view of the printing cylinder washer 1 including the drive assembly 100 positioned on a support table 11. FIG. 1 shows the same perspective view of the printing cylinder washer 1 but without the drive assembly 100 to illustrate how the reservoir 10 with a support table 11 can be raised or lowered within the reservoir 10 from a low position (shown by dashed lines) and a high position as depicted. One of ordinary skill in the art will recognize that the support table 11 can be moved by way of mechanical, hydraulic, pneumatic, and electro-mechanical means, including but not limited to a sliding rail or an elevator system 14 located behind the support table 11 activated from the command bay 17 for raising or lowering the support table 11. It is also contemplated that the use of a fixed support table 11 with retractable or adjustable legs positioned either directly on the bottom 50 of the reservoir 10 or on an edge (not shown) made on the sidewalls 7 of the reservoir 10 forming a collecting pan.

In FIG. 1, the support table 11 is shown as a grate that allows the flow of cleaning solution 39 (shown in FIG. 5) within the reservoir 10 such that debris and other particles to drop down into the cleaning solution 39 during cleaning and fall to the lower parts of the washer 1 where, in a preferred embodiment, debris can be funneled into a bend 48 formed in the bottom 50 located next to a drain 4 with a control valve 5 as shown in FIG. 8. A debris collection system is shown that operates under the principle that any debris or particle with a density superior to the cleaning solution 39 drops under its own weight to the lower parts of the reservoir 10 between washing cycles. Alternately, particles or debris of lesser density than the cleaning solution 39 rise to the surface where they can be filtered by an external filter 27 before cleaning solution 39 is cycled back into the reservoir 10.

Figure 5:
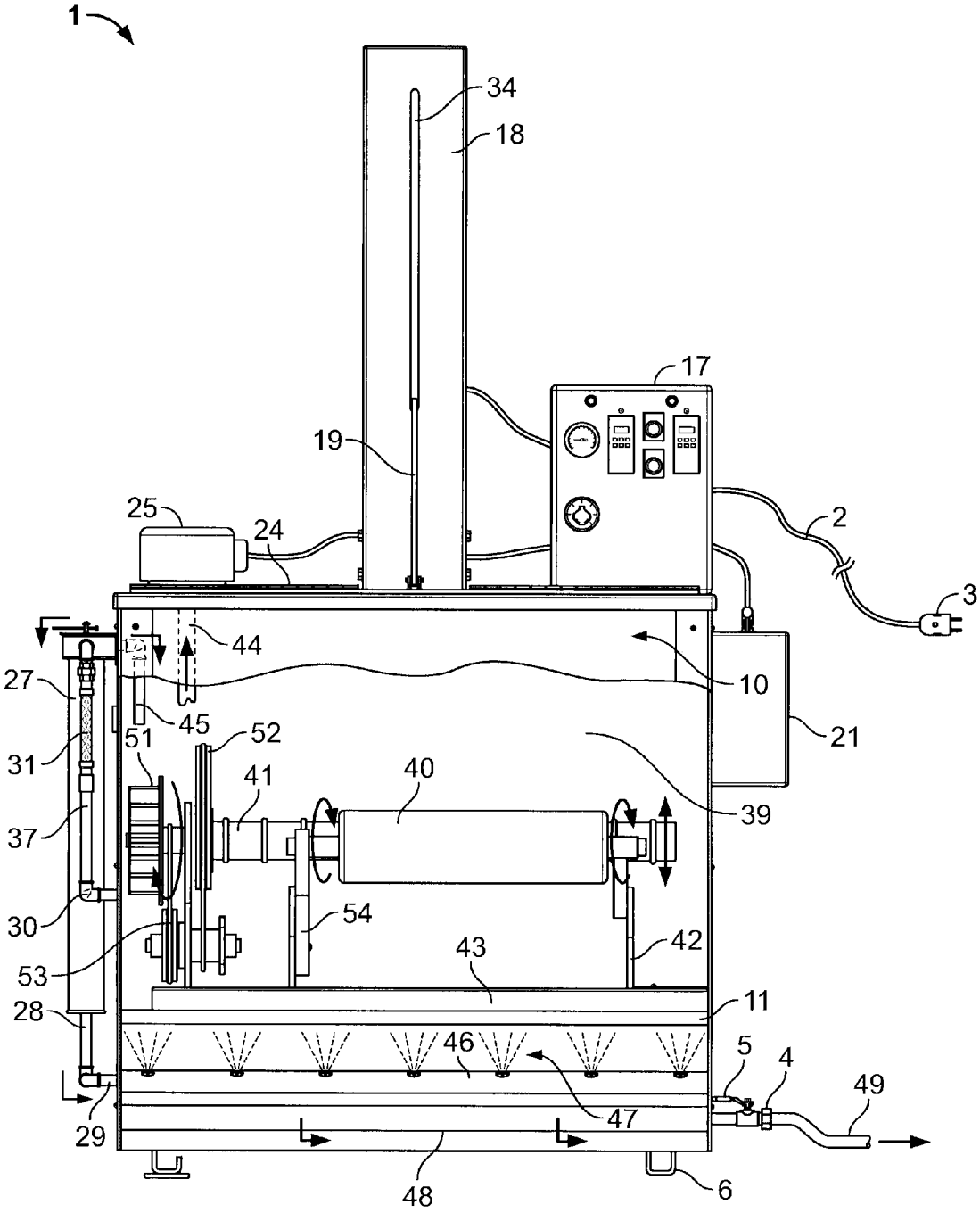
FIG. 5 is a functional diagram of the printing cylinder washer with drive assembly and a printing cylinder according to an embodiment of the present disclosure.

FIG. 8 shows a printing cylinder washer 1 with a reservoir 10 that defines a volume between the bottom 50 and the sidewall 7 in which a cleaning solution 39 and a support table 11 are disposed. The washer 1 also includes a pump 25 having an inlet 44 in fluidic contact with the cleaning solution, a first outlet 29 connected to a spray bar 46, and a second outlet 30 connected to a directional nozzle 45 as shown in FIG. 5. The reservoir 10 also includes a top door 9 shown as a flat, hinged door having an automated opening system 19 as shown in the open position in FIG. 5 and in the closed position in FIG. 2.

The top door 9 is equipped with a lift bar 19 attached to a thermal breaker 23. A mechanical system in the lift column 18 allows the lift bar 19 to slide up the slide 34 to pull the door 9 on its hinge 24. While one mechanical door opening system is shown, it is contemplated that the use of any mechanical or electro-mechanical system capable of opening the door, including but not limited to a retractable door made of segments, a drop-down door slidably connected to the sidewall 7 in rails, a magnetic lift system or the like. The thermal breaker 23 is a device calibrated to release the lift bar 19 from its attachment point on the top door 9 if a certain temperature is reached for a certain period of time. Thermal breakers 23 are calibrated to release the door in the event of internal combustion of the cleaning solution 39 or surface chemicals on the cleaning solution 39 within the reservoir 10.

Figure 2:
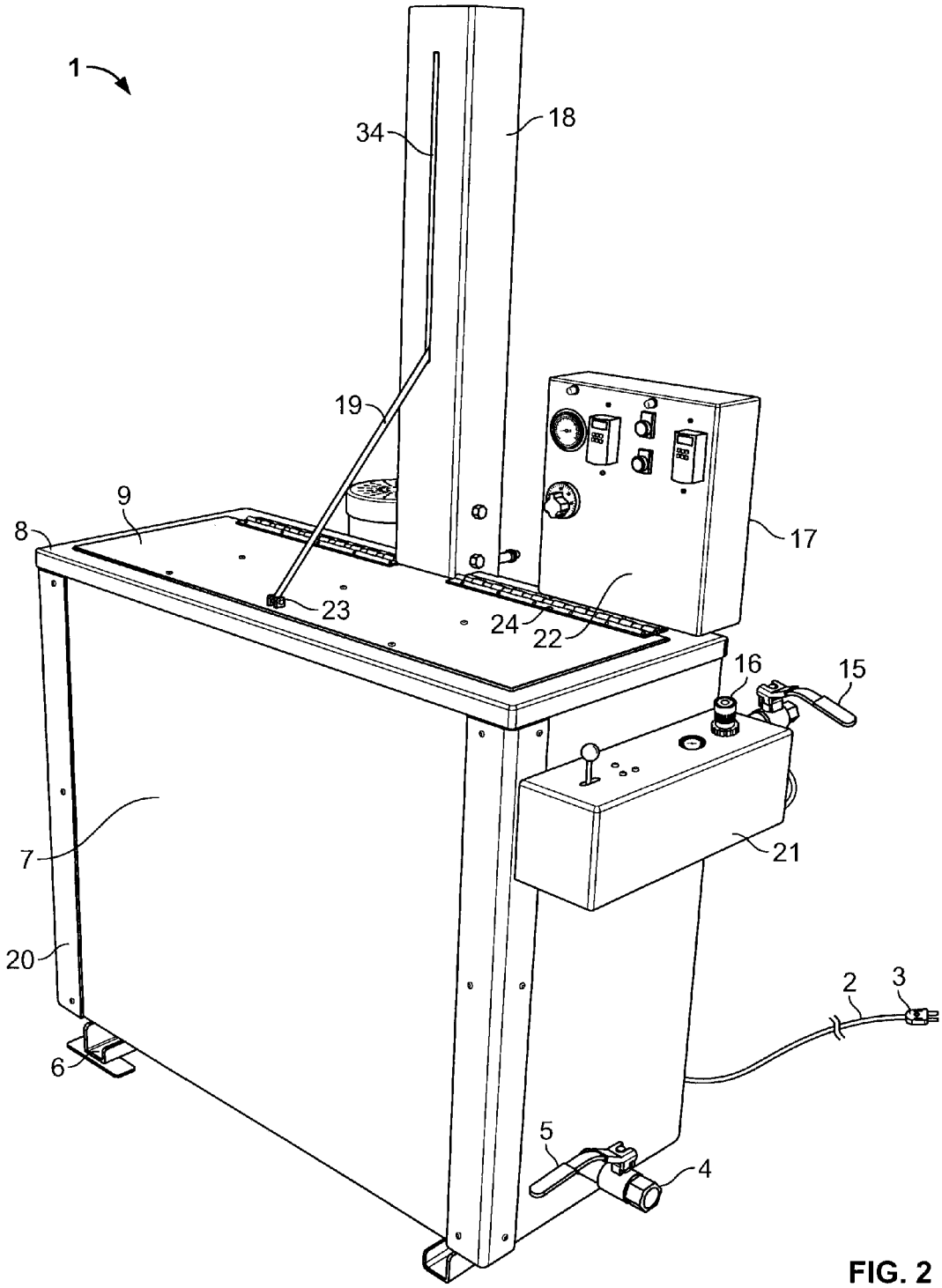
FIG. 2 is a perspective view of the printing cylinder washer with the reservoir door in a closed position.

FIG. 2 also shows known control command systems used in connection with the novel features of this disclosure. For example, command bay 17 includes a timer, a temperature detector, activating and deactivating buttons, and programming devices to control the different washing parameters within the reservoir 10. In some embodiments, a heater (not shown) can be used to increase the temperature of the cleaning solution 39 to increase dilution properties of the cleaning solution 39. The command bay 17 is preferably used for ordinary controls, including a pump control 25 to regulate the flow of spray 47 within the reservoir 10 or to regulate the flow of cleaning solution 39 out of the directional nozzle 45 to increase or decrease the speed of the drive cylinder 41 via the drive wheel 51.

Figure 3:
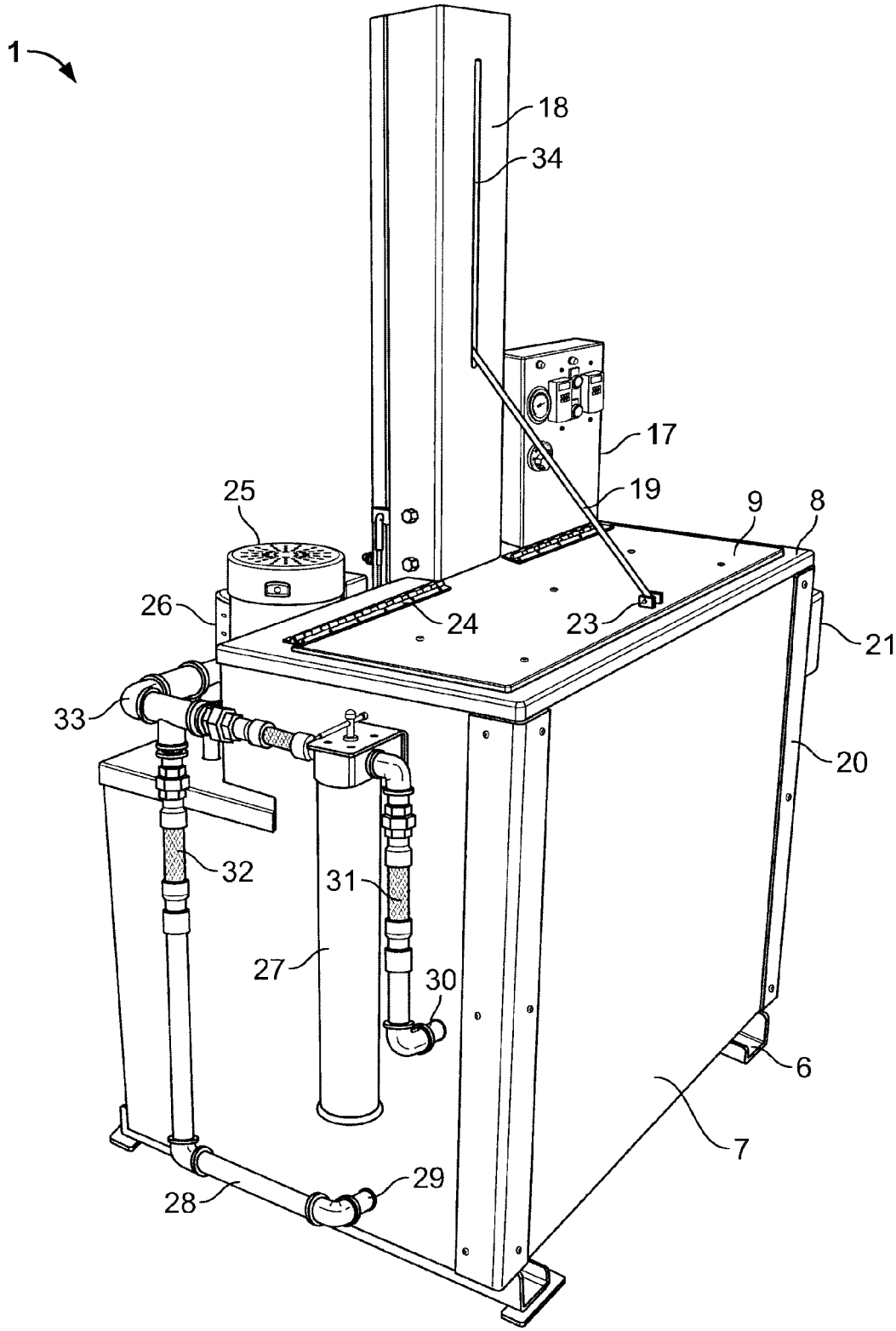
FIG. 3 is a front left perspective view of the printing cylinder washer of FIG. 2 shown from a different point of view to illustrate the pumping and filtration system according to an embodiment of the present disclosure.
Figure 4:
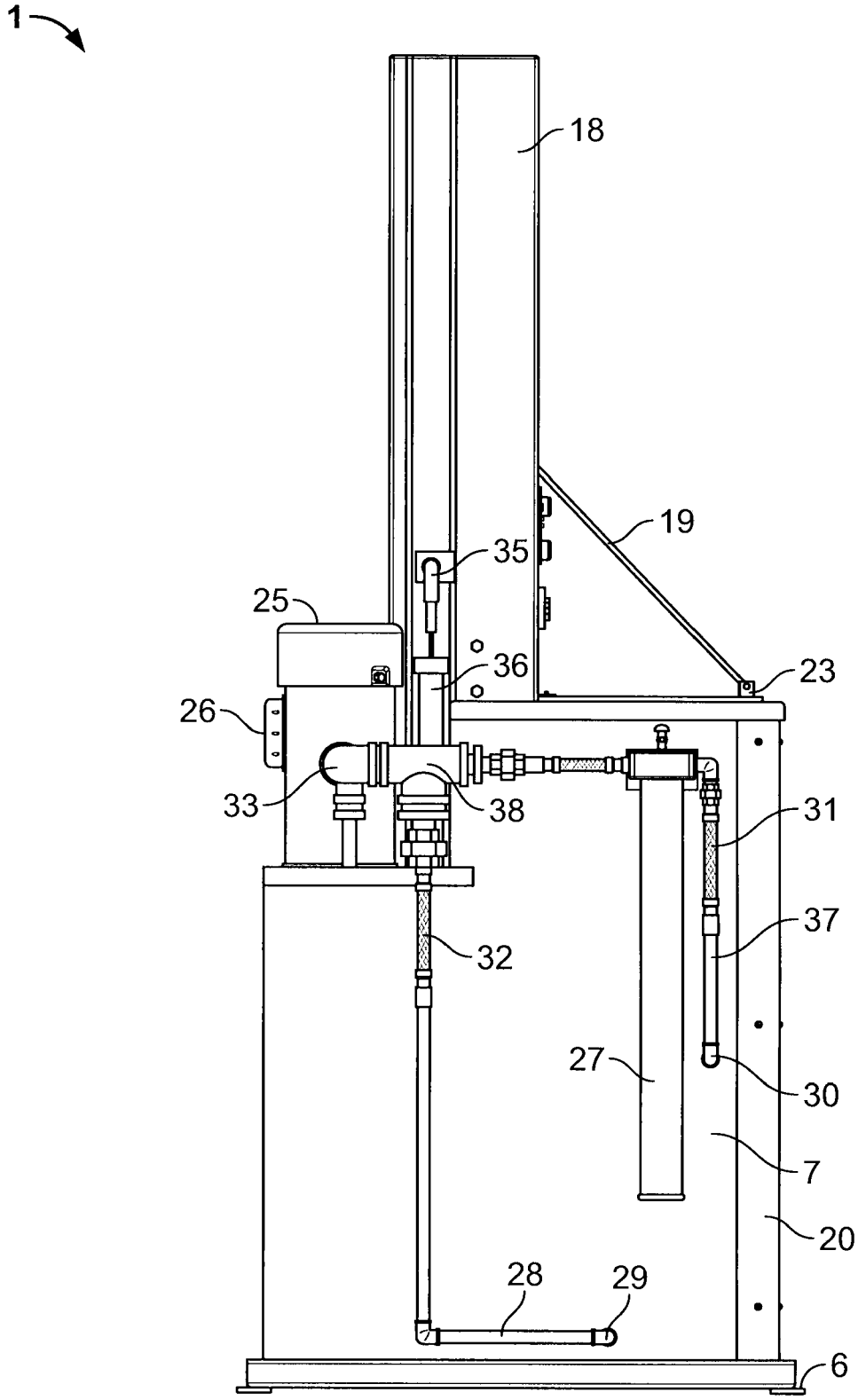
FIG. 4 is a side view of the printing cylinder washer of FIG. 3 according to an embodiment of the present disclosure.

The control bay 21 as shown may include flow valves 15 and air valves 16 associated with a pressure gage to regulate an ultrasound vibration head designed to introduce and maintain vibration waves within the cleaning solution 39 to help dislodge dirt particles that adhere to the surface of the print roller 40. In another embodiment, the vibration device is a transducer. The control bay 21 also includes a lift lever shown as a joystick with a ball and control buttons to control the vertical displacement of the support table 11. The control bay 21, the command bay 17, and the different connected elements, such as the pump 25 and the command block of the pump 26 as shown in FIG. 3, include when needed control valves, flow valves, reductions, transformers, and different smaller mechanical and electrical components generally known in the art. The electrical system in one embodiment as shown is connected to an external power network via a cable 2 having a plug 3. While the use of an external power supply is shown, it is also contemplated that any means to power the different elements, include the use of an alternate generator or even batteries may be used.

The washer 1 in a preferred embodiment includes U-shaped tubes 6 attached to the bottom 50 of the reservoir 10 for lifting the washer 1 using forks placed on a handheld forklift or automated forklift (not shown). While one portable means of positioning and transportation is shown, it is contemplated is any system to hold, store, position, or transport the washer 1 may be used. Other structural reinforcements, such as L-shaped bars 20, are shown at the external edges of the sidewall 7 to reinforce the reservoir 10. The top edge of the reservoir is also shown in a preferred embodiment having a frame 8 made to hold and protect the upper edge of the sidewall 7 but also to support the top door 9 and create a seal for trapping any potential fumes created by the cleaning solution 39 within the reservoir 10. FIG. 1 also shows by way of example back internal reinforcements 13. It is contemplated that any mechanical structural reinforcement placed inside or outside of the reservoir 10 to maintain structural integrity when the washer 1 is filled or moved may be used.

FIG. 3 shows a front left perspective view of the printing cylinder washer of FIG. 2 shown from a different point of view to illustrate the pumping and filtration system according to an embodiment of the present disclosure. The system as shown is designed for high-pressure operation and includes fixed, rigid piping 33, 28 connected to the pump 25 and to either the spray bars 46 through a first outlet 29 or a nozzle 45 through a second outlet 30. The different elements as shown are connected by a series of high-pressure metal hoses 32, 31. A filtering cartridge 27 with a top manual valve 74 can be used to control the flow of cleaning solution 39 from the pump to the second outlet 30 and ultimately the directional nozzle 45. In one embodiment, the pump 25 is calibrated for a fixed flow of cleaning solution 39 that is fully directed to the spray bars 46 when the manual valve 74 is closed and when no driving force is required on the drive wheel 51. As the manual valve 74 is opened, the flow of cleaning solution 39 to the spray bars 46 is reduced based on the different elements of the system. One of ordinary skill in the art knows multiple methods that may be implemented to calibrate the flows through the first outlet 29 and the second outlet 30, including but not limited to manual valves, calibrated diaphragms, automated valves, multiple parallel pumps 25, different sizes of piping or reduced sections of high pressure hose, etc.

Figure 6:
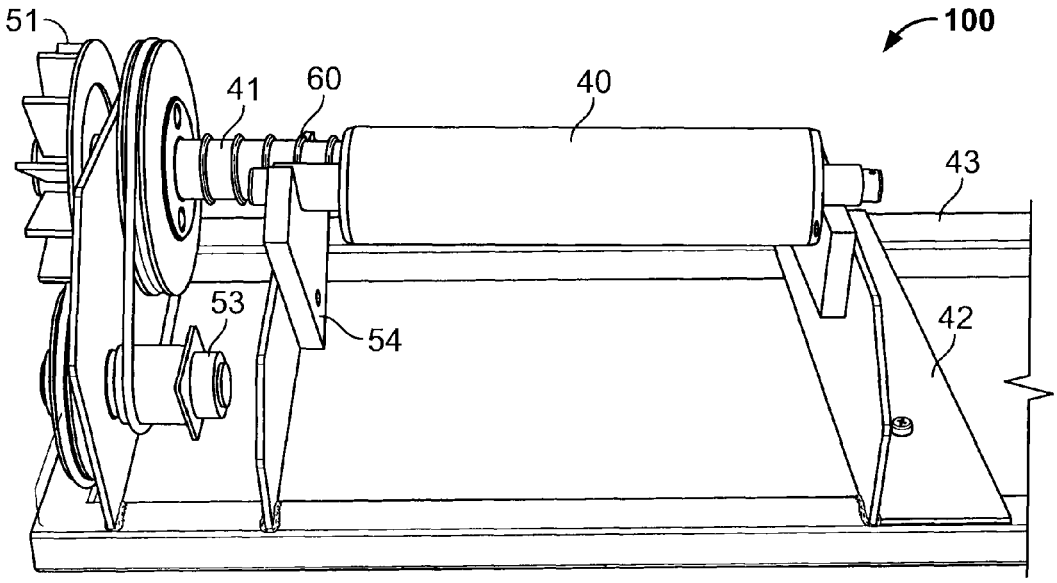
FIG. 6 is a perspective view of the drive assembly with a printing cylinder according to an embodiment of the present disclosure.
Figure 7:
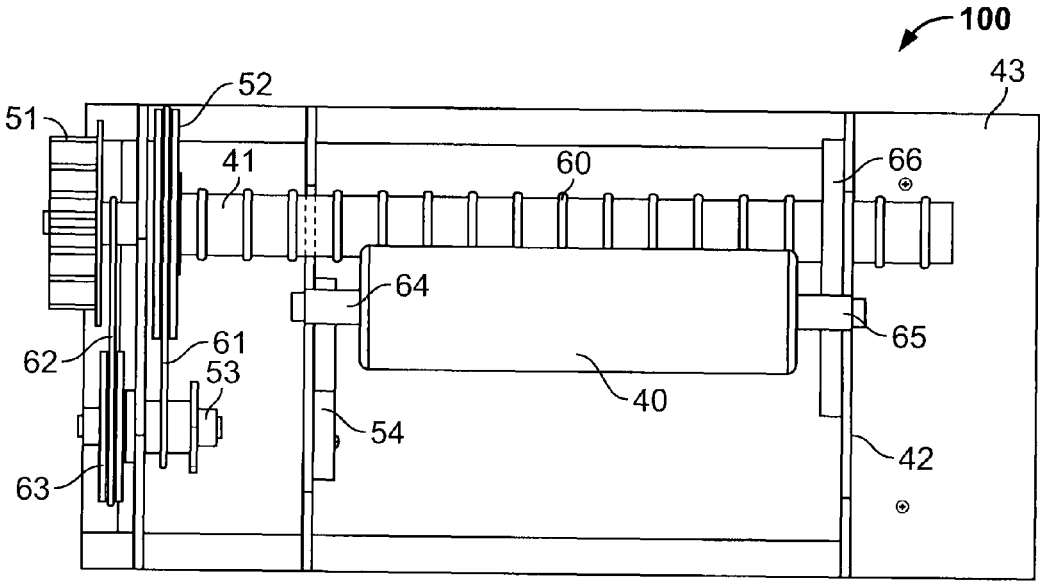
FIG. 7 is a top view of the drive assembly as shown in FIG. 6.

FIG. 6 is a perspective view of the drive assembly 100 with a printing cylinder 40 according to an embodiment of the present disclosure. It is further contemplated that the assembly includes a frame 43 made of metal tubes and plates. In one embodiment, the different structural elements of the frame 43 are assembled using welds and screws. The frame 43 is also open below the printing cylinder 40 to improve the circulation of the cleaning solution 39 within the reservoir 10. It is further contemplated, but not shown that a frame 42 with an end support plate 42 that is slidably connected to the bottom frame to adjust the distance between the two printing cylinder supports 54, 66 mounted on vertical supports may be used.

The printing cylinder washer 1 also includes a drive assembly 100 disposed on the support table 11 with a drive wheel 51, a transmission 53, a drive cylinder 41, and a printing cylinder support 54, 66. In another embodiment, the printing cylinder support 54 allows the printing cylinder 40 to press against the drive cylinder 41 by sliding down along the sliding support 54 to an equilibrium position closest to the drive cylinder 41. In the embodiment, the drive wheel 51 is a paddle wheel for transforming flow movement within the cleaning solution 39 in the reservoir 10 into a rotational driving force at the center of the drive wheel 51. The drive assembly further includes as part of the overall transmission 53 a first strap 62 and a second strap 61 connected to wheels of different radii on the main shaft of the transmission 53. In one embodiment, the drive cylinder 41 includes a large wheel 52 operating with the transmission 53 to produce a velocity of rotation of the drive cylinder 41 required for the drive assembly 100. A transmission 53 may be used to decelerate the rotation of the drive cylinder 41 if the drive flow is too rapid or to accelerate the rotation of the drive cylinder 41 if the drive flow of cleaning solution 39 is insufficient.

A second flow is directed from the inlet 44 to the directional nozzle 45 such that when the cleaning solution 39 is discharged from the directional nozzle 45 in a stream, the cleaning solution contacts the drive wheel 51 whereby the drive wheel 51 rotates and the transmission imparts rotational movement to the drive cylinder 41 from the drive wheel 51. The printing cylinder support 54, 66 disposes a printing cylinder 40 contiguous to the drive cylinder 41, wherein the pump 25 circulates the cleaning solution 39 in the reservoir 10 from the inlet 44 to the spray bars 46 such that when the cleaning solution 39 is discharged from the spray bar 46 a flow of the cleaning solution 47 is defined. A series of cylinder supports 54, 66 is shown where one of the support 54 is angled allowing for the print roller 40, when placed on the support 54 to be pushed against the drive cylinder 41. In one embodiment, a series of small friction tabs 60 placed on the drive cylinder 41 is shown to prevent differential rotation between the drive cylinder 41 and the printing cylinder 40. In other contemplated embodiments, the drive cylinder 41 includes a brushing media or a friction based media to drive the print roller 40. What is also contemplated is the use of a biasing means to pull the print roller 40 against the drive cylinder 41 after the print roller 40 is placed on the cylinder supports 54, 66.

In another contemplated embodiment, the support table 11 is a grate connected to an elevator system (not shown) for raising or lowering the support table 11 and the drive assembly 100 placed upon the grate. In yet another embodiment, the support table 11 is an agitation platform designed to vibrate and agitate a print roller 40 while under immersion.

Figure 9:
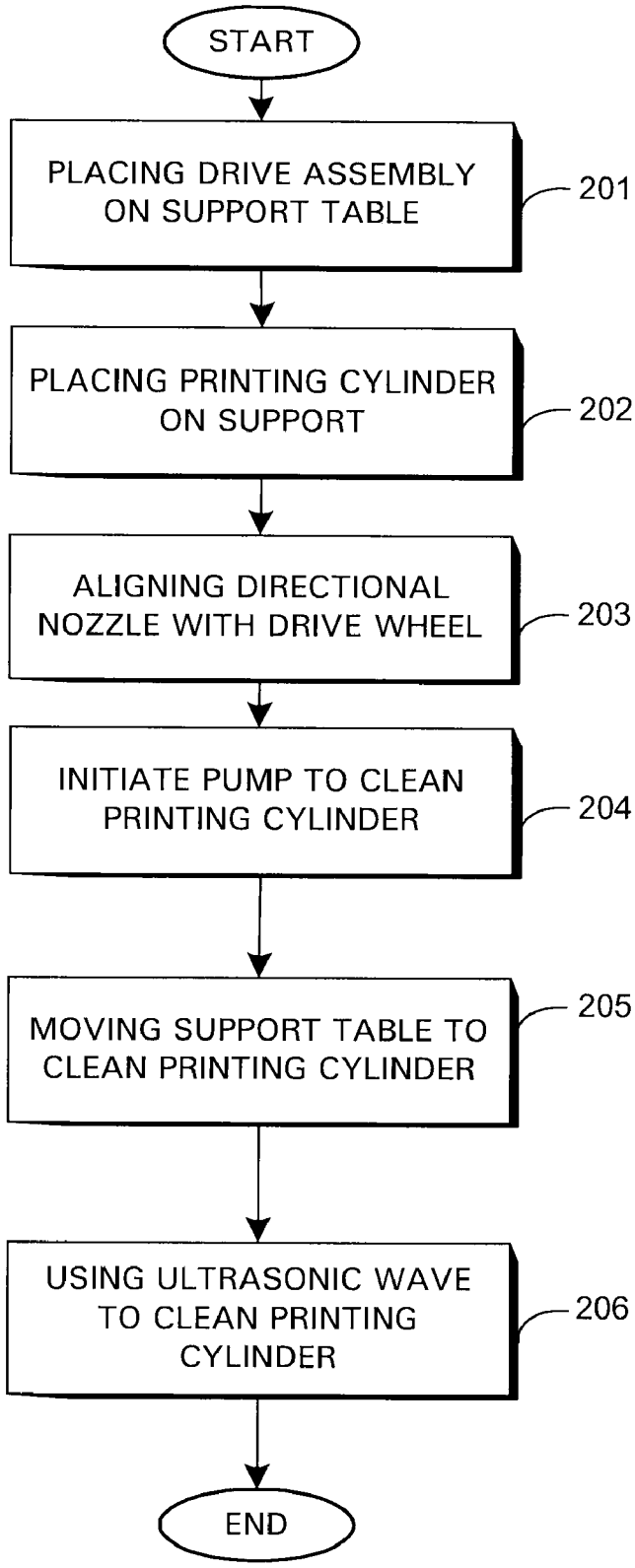
FIG. 9 is a block diagram of a method of washing a printing cylinder in a printing cylinder washer as contemplated in one embodiment of the present disclosure.

FIG. 9 is a block diagram of a method of washing a printing cylinder in a printing cylinder washer as contemplated in one embodiment of the present disclosure. The method includes the successive steps of placing 201 a drive assembly on a support table 11 of a printing cylinder washer 1 having a reservoir 10 defining a volume in which a cleaning solution 39 and the support table 11 are disposed. A printing cylinder 40 to be washed is then placed 202 on the printing cylinder support 54, 66. The directional nozzle 45 is then aligned 203 with the drive wheel 51 and the printing cylinder 40 is placed in the flow of the spray bar 47. The pump 25 is then initiated 204 to direct the cleaning solution 39 through the spray bar 46 via the first outlet 29 to clean the printing cylinder 40 and to direct the cleaning solution 39 through the directional nozzle 45 via the second outlet 30 to energize the drive wheel 51 and rotate the printing cylinder 40. In an alternate embodiment, the method further comprises the step of moving 205 the support table 11 as an agitation platform, and in yet another embodiment, the method further comprises the step of creating 206 ultrasonic waves in the cleaning solution 39 to dislodge dirt particles from a surface of the printing cylinder 40.

Persons of ordinary skill in the art appreciate that although the teachings of the disclosure have been illustrated in connection with certain embodiments and methods, there is no intent to limit the invention to such embodiments and methods. On the contrary, the intention of this disclosure is to cover all modifications and embodiments failing fairly within the scope the teachings of the disclosure.

What is claimed is:

1. A printing cylinder washer for cleaning a printing cylinder with a cleaning solution, said printing cylinder having an outer surface, the printing cylinder washer, comprising: a reservoir defining a volume in which the cleaning solution is disposed and a moveable support table is disposed between a raised position and a lowered position, wherein the support table is submerged in the cleaning solution when disposed in the lowered position; a pump including an inlet in fluidic contact with the cleaning solution, a first outlet connected to a spray bar, said spray bar immersed in the cleaning solution and disposed adjacent the support table when the support table is disposed in the lowered position, and a second outlet connected to a directional nozzle having an outlet disposed submerged in the cleaning solution; and a drive assembly disposed on the support table including a drive wheel disposed in substantial vertical alignment with the directional nozzle, a transmission operatively connected to the drive wheel, a drive cylinder operatively connected to the transmission, and a printing cylinder support movably connected to the support table such that the printing cylinder support disposes the outer surface of the printing cylinder contiguous to the drive cylinder, the printing cylinder support including a pair of support elements disposed at opposed ends of the printing cylinder to engage oppositely disposed printing cylinder axels that extend concentrically along a longitudinal axis from the printing cylinder, wherein one of the pair of support elements includes a biasing mechanism to urge the printing cylinder against the drive cylinder, which has an extent greater than a longitudinal extent of the printing cylinder, wherein, upon activation, the pump circulates the cleaning solution in the reservoir from the inlet to the spray bar such that when the cleaning solution is discharged from the spray bar a flow of the cleaning solution is defined and from the inlet to the directional nozzle such that when the cleaning solution is discharged from the directional nozzle a stream of the cleaning solution is defined that contacts the drive wheel whereby the drive wheel rotates and the transmission imparts rotational movement to the drive cylinder from the drive wheel.

2. The printing cylinder washer of claim 1, wherein the support table is a grate connected to an elevator system for raising or lowering the support table.

3. The printing cylinder washer of claim 1, wherein the support table is an agitation platform.

4. The printing cylinder washer of claim 1, further comprising a filter connected between second outlet and the pump.

5. The printing cylinder washer of claim 1, further comprising a transducer in fluidic communication with the cleaning solution for sending ultrasonic waves in the cleaning solution to clean the printing cylinder.

6. The printing cylinder washer of claim 1, further comprising a top door on the reservoir to provide access an interior portion of the reservoir.

7. The printing cylinder washer of claim 6, further comprising a lift column and a lift bar for connecting the top door to the lift column.

8. The printing cylinder washer of claim 7, wherein the lift bar includes a thermal breaker.

9. The printing cylinder washer of claim 1, wherein the drive cylinder further includes a plurality of friction tabs disposed of spaced locations along the longitudinal extent of the drive cylinder to distribute rotation forces at a plurality of locations along the longitudinal extent of the drive cylinder and to prevent differential rotation between the drive cylinder and the printing cylinder.

10. The printing cylinder washer of claim 1, wherein the reservoir further comprises a drain and a collecting pan.

11. The printing cylinder washer of claim 1, wherein the drive train includes at least one transmission strap.

12. The printing cylinder washer of claim 1, wherein the biasing mechanism includes one of the pair of support elements having an upper surface angled with respect to the drive cylinder.

* * * * *